US008408435B2

(12) United States Patent
Refsum

(10) Patent No.: US 8,408,435 B2
(45) Date of Patent: Apr. 2, 2013

(54) BABY HARNESS

(75) Inventor: Bjorn Refsum, Alesund (NO)

(73) Assignee: Stokke AS (NO)

( * ) Notice: Subject to any disclaimer, the term of this patent is extended or adjusted under 35 U.S.C. 154(b) by 1420 days.

(21) Appl. No.: 10/483,918

(22) PCT Filed: Jul. 11, 2002

(86) PCT No.: PCT/NO02/00256

§ 371 (c)(1),
(2), (4) Date: Jul. 26, 2004

(87) PCT Pub. No.: WO03/009728

PCT Pub. Date: Feb. 6, 2003

(65) Prior Publication Data

US 2004/0245298 A1 Dec. 9, 2004

(30) Foreign Application Priority Data

Jul. 13, 2001 (NO) ..... 20013496

(51) Int. Cl.

| | |
|---|---|
| ***A61G 1/00*** | (2006.01) |
| ***A61G 5/00*** | (2006.01) |
| ***A45C 13/30*** | (2006.01) |
| ***A45F 3/00*** | (2006.01) |
| ***A45F 3/02*** | (2006.01) |

(52) U.S. Cl. ..... 224/159; 224/600; 224/605; 224/625; 224/158

(58) Field of Classification Search ..... 224/158, 224/159, 600, 605, 625
See application file for complete search history.

(56) References Cited

U.S. PATENT DOCUMENTS

| | | | | |
|---|---|---|---|---|
| 3,027,058 | A * | 3/1962 | Huber | 224/155 |
| 4,149,687 | A * | 4/1979 | Nunemacher | 224/159 |
| 5,361,952 | A * | 11/1994 | Gold | 224/159 |
| 5,435,272 | A | 7/1995 | Epstein | |
| 5,766,114 | A | 6/1998 | Campbell | |
| 5,791,535 | A * | 8/1998 | Roan et al. | 224/160 |
| D453,066 | S * | 1/2002 | Norman | D3/214 |
| 6,397,389 | B1 * | 6/2002 | Schultz | 2/69 |
| 6,415,969 | B1 * | 7/2002 | Higuchi | 224/160 |
| 6,836,902 | B2 * | 1/2005 | Marquez et al. | 2/69 |

FOREIGN PATENT DOCUMENTS

| | | | |
|---|---|---|---|
| DE | 9419975 | U1 | 3/1995 |
| DK | 2000 00160 | | 7/2000 |
| DK | 2000 00160 | U3 * | 7/2000 |
| HU | P9302836 | A | 9/1995 |
| RU | 2161010 | C1 | 12/2000 |

* cited by examiner

*Primary Examiner* — Justin Larson
*Assistant Examiner* — Lester L Vanterpool
(74) *Attorney, Agent, or Firm* — Kolisch Hartwell, P.C.

(57) ABSTRACT

The present invention concerns a small and neat harness (1) of light weight, which may be carried by the child as a garment, and which gives the child ample freedom of movement when it walks on its own, yet support while being carried. The harness may swiftly be coupled to and from a carrying strap (14) in order to carry the child, or for example to a pram or chair as a safety harness. The harness (1) may in addition be used as a walking or safety harness when the child wants to walk by itself.

8 Claims, 3 Drawing Sheets

BABY HARNESS

The present invention concerns a carrier for children which is carried by the child as a garment and which may be used for several purposes.

BACKGROUND OF THE INVENTION

Several aids for carrying children are available today, such as baby carrier harnesses for infants and child carrier harnesses which may also be used for somewhat older children. A baby carrier or child carrier is often used as an alternative to a pram or pushchair, especially in terrain not suited for a pram. Furthermore, a baby or child carrier, especially a child carrier, is not as bulky as prams and occupy less space during transport when not in use. Baby and child carriers help the child to sit upright in order to look around and in the child having close contact with the child attendant, and participates more actively in activities.

The problem with the existing baby and child carriers is that the child must be installed before the baby or child carrier may be used, for thereafter to be detached from both the child and the carrying person, when the baby carrier or child carrier is not to be used. With the present carrier, the child must either be seated or laid down in order to dismount or mount the carrier on the child or the harness must partly be mounted on the carrier before the child is entered into the harness and thereafter fastened more permanently, and the reverse procedure must be followed in order to take the child out of the carrier. In child carriers, the child must be seated into the carrier which is standing on the ground for example, then the child must be fastened with a safety harness, and finally the child carrier may be lifted carefully onto the back of the carrying person. In order to take the child out of the child carrier, the same procedure must be repeated in the reverse order. This is cumbersome and time consuming, especially as the child often wants to walk a little by itself, then be carried a short while, and then walk a little again, and so on. Today's baby carriers are also bulky; it is not possible for the child to move while wearing the carrier, as the object of these baby carriers is only that the child is comfortable while it is being carried.

There are also safety harnesses for children available on the market for preventing children from falling out of chairs or prams. These harnesses may be worn by the child more permanently, and they may be fastened to a pram or chair, or to a security strap which the child attendant may hold when the child walks by itself. These harnesses often have only abdominal and shoulder straps and only stops sideways and upward movement, to prevent the child from climbing out of the seat. These harnesses do not hinder the child in edging out beneath the harness. To prevent just this, some safety harnesses are equipped with a strap between the legs, but this is only for safety reasons and is not designed for lifting the child.

There exists therefore a need for a carrier harness which the child may permanently wear and which may be used both as a carrier, safety harness and walking rein alternately, without elaborate mounting and dismounting.

DESCRIPTION OF THE INVENTION

The present invention solves the above mentioned problem by a small and neat baby harness of light weight which may be carried by the child as a garment, and which provides the child ample freedom of movement when it walks on its own, and yet provides support while being carried. The baby harness may swiftly be coupled to and from a carrying strap in order to carry the child, or for example to a pram or chair as a safety harness. The baby harness may in addition be used as a walking or safety harness when the child wants to walk by itself.

FIGURES

DESCRIPTION

Figure 1:
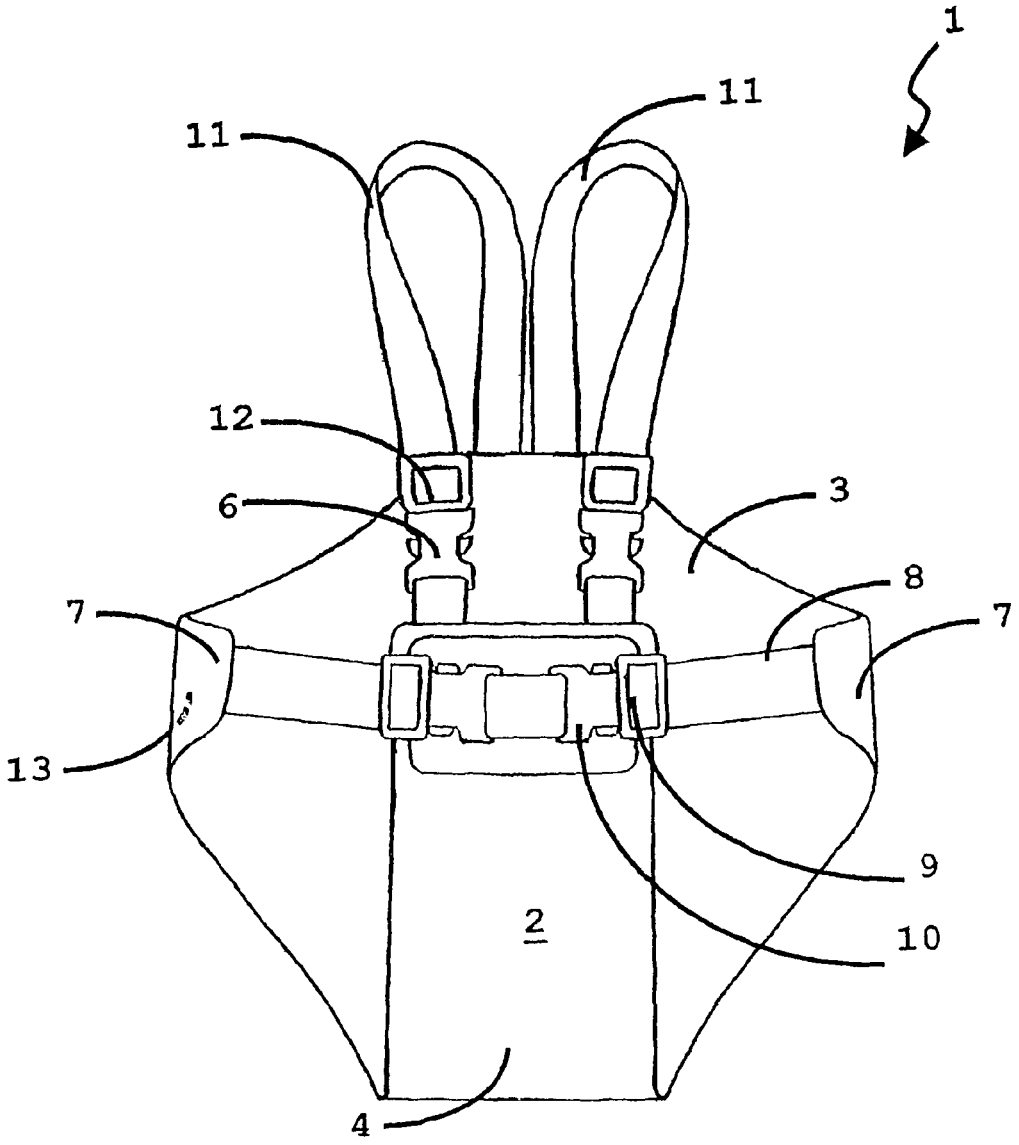
FIG. 1 depicts the carrier harness seen from the front.

The baby carrier 1 consists of a yoke 2, with a back piece 3, a front piece 4 and two side pieces 7, wherein the side pieces 7 are connected with the front piece 4 by length adjustable side straps 8 so that the mentioned elements constitute a seat element in the form of a small trouser. The length adjustable side straps 8, may alternatively in addition, each be equipped with a locking device 9, in order to be detachably connected to the front piece 4, which may contain corresponding locking devices 10. The locking devices may have the form of snap-in locks.

From the back piece's 3 upper back part, two shoulder straps extend which are length adjustably mounted to the front piece 4, preferably by the shoulder straps 11 being provided with locking devices 12, that fit into corresponding locking devices 6, mounted on the front piece 4, preferably in the form of snap-in locks.

Figure 2:
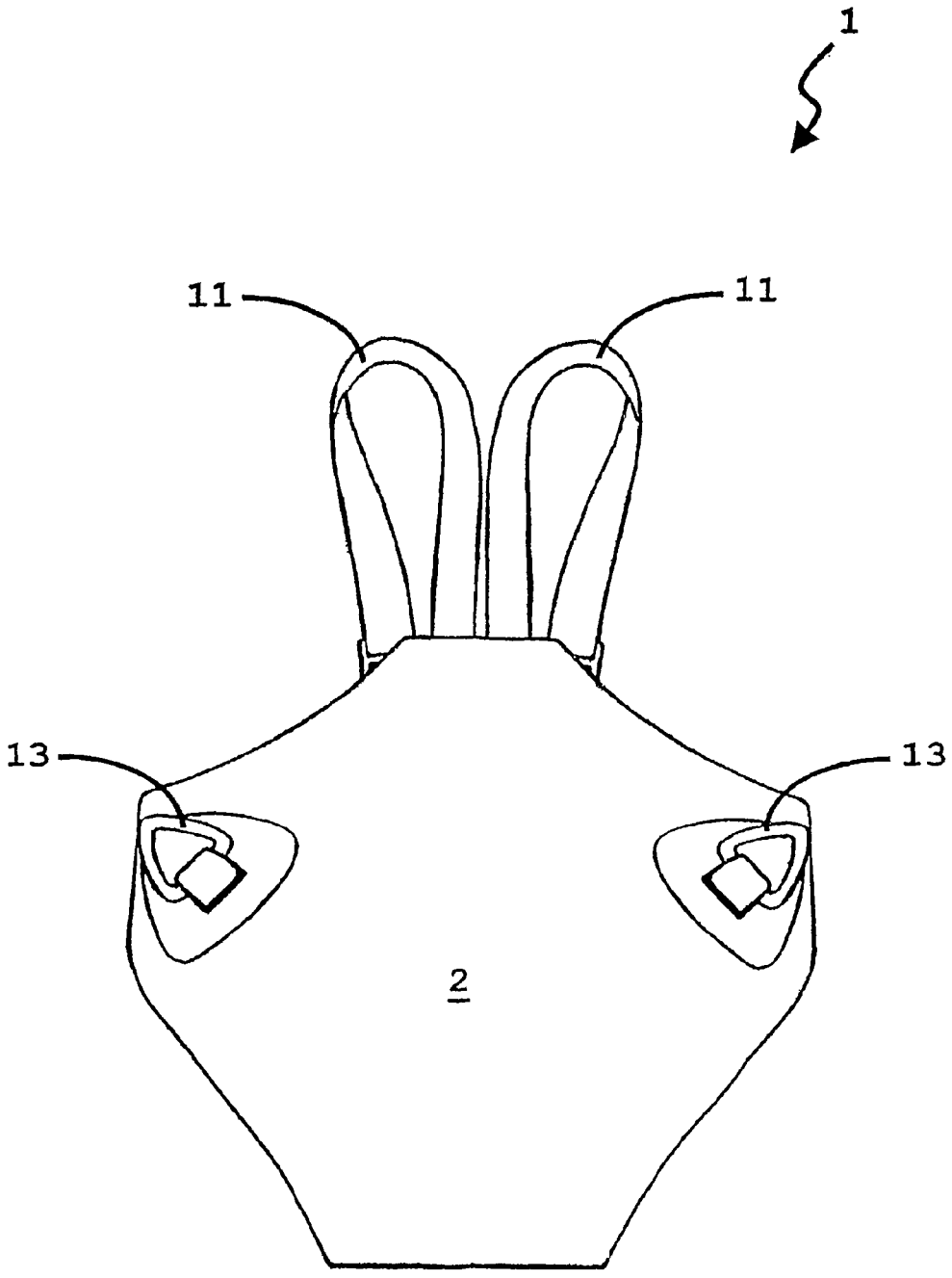
FIG. 2 depicts the carrier harness seen from behind.

As shown in FIG. 2, further fastening devices 13 are mounted on the side extremities of the back piece's 2 outer area, here in the form of eyes, for fastening of the carrying strap 14 or for fastening to other seats for the child.

Figure 3:
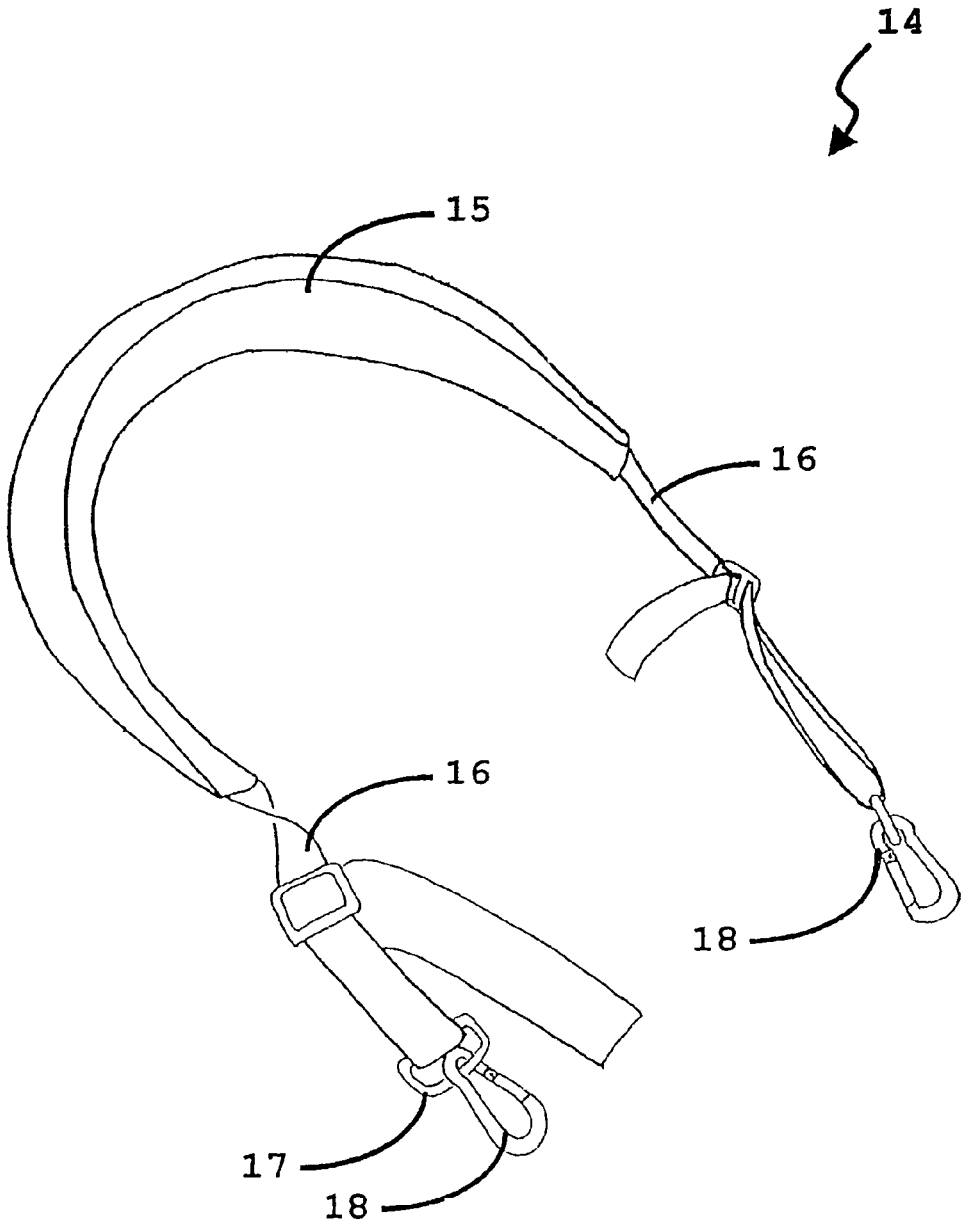
FIG. 3 depicts the shoulder strap for the carrier harness in FIG. 1.

The carrying strap 14 as shown in FIG. 3 consists in this embodiment of a padded shoulder strap 15, with length adjustable straps 16 in each end which may have hoops 17 for the fastening of snap hooks 18. The shoulder strap 15 has an especially broad and arched form-like a cap in this embodiment, in order to fit well, around the shoulder ball on the opposite side to which the child is carried. The shoulder strap 15 may have a pocket for storing small things or the baby harness 1 when it is not in use. The pocket may be shut by a zip or Velcro®.

One advantage with the carrier harness is that it may be used as a baby carrier using the carrying strap 14, and the child may be sat down on the ground and walk by itself when it wants to, without necessarily uncoupling the carrying strap 14. The carrying strap 14 may be used as a walking rein or a safety chain while the child walks, and then again lift the child up when it is tired or the terrain is unsuitable. Alternatively, the shoulder straps 11 may be equipped with fastening devices, for example in the form of loops, so that the carrying strap 14 may be fastened to these when the harness is used as a walking harness (not shown). The carrying strap 14 may with great ease swiftly be uncoupled from the baby harness, so that the child may walk completely freely, be placed in a car safety seat or be fastened by the fastening devices in a variety of seats such as, for example, a babies high chair (at home, in a café or restaurant), baby rocking chair, pram, shopping trolley, bicycle seat, kick sledge, sleigh, etc.

The only thing the child attendant needs to carry alongside is the carrying strap 14 when it is not in use. It may alternatively hang around the child attendant's shoulder or waist, by coupling the hook locks 18 together, and in this way free both hands.

The invention claimed is:

1. A harness (1) for a child, comprising a unitary yoke (2) having a back portion (3), a front portion (4) and two side portions (7), where the side portions (7) extend from the back portion (3) and are connected with the front portion (4) by length adjustable side straps (8), so that the mentioned parts constitute a seat element, with length adjustable shoulder straps (11), from the upper back part of the back portion (3) to the front portion (4), wherein the back portion (3) also has fastening devices (13) in the side extremities on the outer area, which makes fastening of a carrying strap or fastening to seats for children possible.

2. The harness according to claim 1, characterized in that the harness' (1) shoulder straps (11) are provided with locking devices (12), for detachable fastening to corresponding locking devices (6) on the front portion (4).

3. The harness according to claim 1, characterized in that the harness' (1) side straps (8) are provided with locking devices (12), for detachable fastening to corresponding locking devices (10) on the front portion (4).

4. The harness according to one of claims 1-3, characterized in that the harness (1) in addition comprises one single length adjustable carrying strap (14) which may swiftly be completely uncoupled from and coupled to the harness by the fastening devices (13) of the harness (1) by adapted fastening devices (18) at the ends of the carrying strap (14).

5. The harness according to one of claims 1-3, characterized in that the harness (1) may be carried by the child as a garment when it walks by itself, when it is carried with the carrying strap (14) or is fastened to a seat.

6. Use of a harness according to one of claims 1-3, as a garment for a child when it walks by itself, when it is carried with the carrying strap (14) or is fastened to a seat.

7. The harness according to claim 5, characterized in that harness (1) may be carried by the child as a garment when it is fastened to a seat that is a babies high chair, baby rocking chair, pram, shopping trolley, bicycle seat, kick sledge or sleigh.

8. The use of a harness according to claim 6, as a garment for a child when it is fastened to a seat that is a babies high chair, baby rocking chair, pram, shopping trolley, bicycle seat, kick sledge or sleigh.

* * * * *